United States Patent [19]

Tsuyoshi et al.

[11] Patent Number: 4,974,967

[45] Date of Patent: Dec. 4, 1990

[54] LAUNDRY NET

[76] Inventors: Hiruma Tsuyoshi, 8-7, Sakura-machi, Koga-shi, Ibaraki-ken, Japan; Sung Kyu Hong, 3643 Ocean Hill Way, Malibu, Calif. 90265

[21] Appl. No.: 460,399

[22] Filed: Jan. 3, 1990

[51] Int. Cl.[5] ..... B65D 30/06; B65D 30/10; B65D 33/16

[52] U.S. Cl. ..... 383/97; 383/102; 383/117

[58] Field of Search ..... 383/97, 102, 117

[56] References Cited

U.S. PATENT DOCUMENTS

| | | | |
|---|---|---|---|
| 2,511,644 | 6/1950 | Liss | 383/102 |
| 2,602,482 | 7/1952 | Lyon | 383/97 |
| 2,804,898 | 9/1957 | Cox | 383/102 |
| 2,818,900 | 1/1958 | Forman | 383/102 |
| 3,073,367 | 1/1963 | Samara | 383/97 |
| 3,422,867 | 1/1969 | Wu | 383/97 |
| 4,286,345 | 9/1981 | Moher | 383/97 |
| 4,630,312 | 12/1986 | Milstein . | |

*Primary Examiner*—Stephen P. Garbe
*Attorney, Agent, or Firm*—Koda & Androlia

[57] ABSTRACT

A laundry net is diclosed which includes a net body formed into an octahedron, which is made by stitching four net members of a rhombic shape together, resulting in a stitched section being formed between each adjacent two net members. Also, the net includes a slide fastener including a slider with a lug and arranged at one of the stitched section and covers arranged at the portion of the one stitched section at which the slide fastener is positioned when the slide fastener is closed. The slider and lug are covered with the overlap portion between the covers. Such construction of the laundry net not only permits water to constantly flow into the net body and through the interior of the net body irrespective of its position with respect to the flow of water in the wash tub of the washing machine, so that the washing in the net body may be positively contacted with the flowing water but effectively prevents the slider and lug from damaging washing outside the laundry net.

4 Claims, 2 Drawing Sheets

LAUNDRY NET

BACKGROUND OF THE INVENTION

This invention relates to a laundry net, and more particularly to a laundry net for receiving washing therein to protect it when the washing is washed in a wash tub of a washing machine.

It is highly troublesome to wash delicate products such as stockings, a silk product and the like. For example, stockings are so long that when they are directly put in a wash tub of a washing machine for the purpose of laundering, they are entangled with other washing, resulting in much time being required for loosening the entangled washing after the laundering and the stockings being often damaged. Clothing made of a delicate material such as silk or the like is often damaged at its surface when it is contacted with other washing during a laundering operation. Thus, delicate products such as stockings, a silk product and the like are generally washed while being received in a laundry net for the protection.

A typical laundry net which has been conventionally used for this purpose is disclosed in Japanese Utility Model Application Laid-Open Publication No. 777/1983, the disclosure of which is incorporated herein by reference. The laundry net disclosed is generally constructed in such a manner as shown in FIG. 1.

More particularly, FIG. 1 shows a laundry net which includes a net body 1, which, in FIG. 1, is expanded into a substantially cylindrical shape. Also, the laundry net includes a slide fastener 2 provided on the net body 1 which is slidably actuated so as to open the net body 1 for the taking in and out of washing with respect to the net body 1.

As described above, the net body 1 of the laundry net takes a cylindrical shape when it is expanded, so that the axis of the net body 1 readily conforms to the direction of flowing of water in a wash tub of a washing machine, resulting in the net body being moved with the flowing of water. Unfortunately, this hinders water from effectively flowing to and through the rear portion of the interior of the net body 1, to thereby fail to uniformly wash washing received in the laundry net.

Further, the conventional laundry net is so constructed that a slider 3 of the slide fastener 2 and its lug are exposedly arranged on the net body 1, so that they often damage washing outside the net.

SUMMARY OF THE INVENTION

The present invention has been made in view of the foregoing disadvantage of the prior art.

Accordingly, it is an object of the present invention to provide a laundry net which is capable of permitting washing put therein to be effectively and uniformly washed.

It is another object of the present invention to provide a laundry net which is capable of accomplishing an increase in laundry efficiency.

It is a further object of the present invention to provide a laundry net which is capable of permitting water to flow throughout the interior of the laundry net.

It is still another object of the present invention to provide a laundry net which is capable of permitting the access of water with respect to the laundry net to be carried out at the whole net.

It is yet another object of the present invention to provide a laundry net which is capable of effectively preventing washing from being damaged during a laundering operation.

It is still a further object of the present invention to provide a laundry net which is capable of accomplishing the above-described objects with a simple construction.

In accordance with the present invention, a laundry net is provided. The laundry net includes a net body formed into an octahedron, which comprises four net members formed into a rhombic shape and joined together by stitching, resulting in a stitched section being formed between each adjacent two net members. Also, the laundry net includes a slide fastener including a slider and arranged at one of the stitched sections and cover means arranged at the portion of the one stitched section at which the slide fastener is positioned when the slide fastener is closed, to thereby cover the slider of the slide fastener.

Such construction of the present invention permits water to constantly flow into the net body and through the interior of the net body irrespective of its position with respect to the flow of water in a wash tub of a washing machine, so that washing in the net body may be positively contacted with the flowing water, resulting in stain being effectively removed from the washing.

Also, the slider of the slide fastener is positively covered with the cover means, to thereby effectively prevent the slider from damaging washing outside the laundry net.

In a preferred embodiment of the present invention, the cover means comprises two covers arranged in a manner to form an overlap portion therebetween and the slider is hidden in the overlap portion.

In a preferred embodiment of the present invention, the cover means is made of fabric.

The slider may be provided with a lug. In this instance, the lug is covered with the cover means together with the slider.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
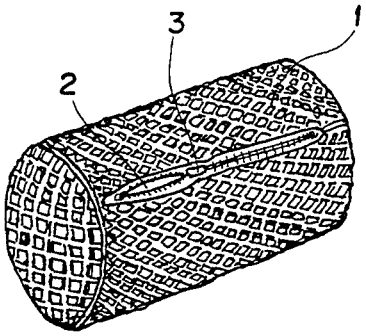
FIG. 1 (PRIOR ART)
FIG. 1 is a perspective view showing a conventional laundry net.

Now, a laundry net according to the present invention will be described hereinafter with reference to FIGS. 2 to 4, in which like reference numerals designate like parts throughout.

Figure 2:
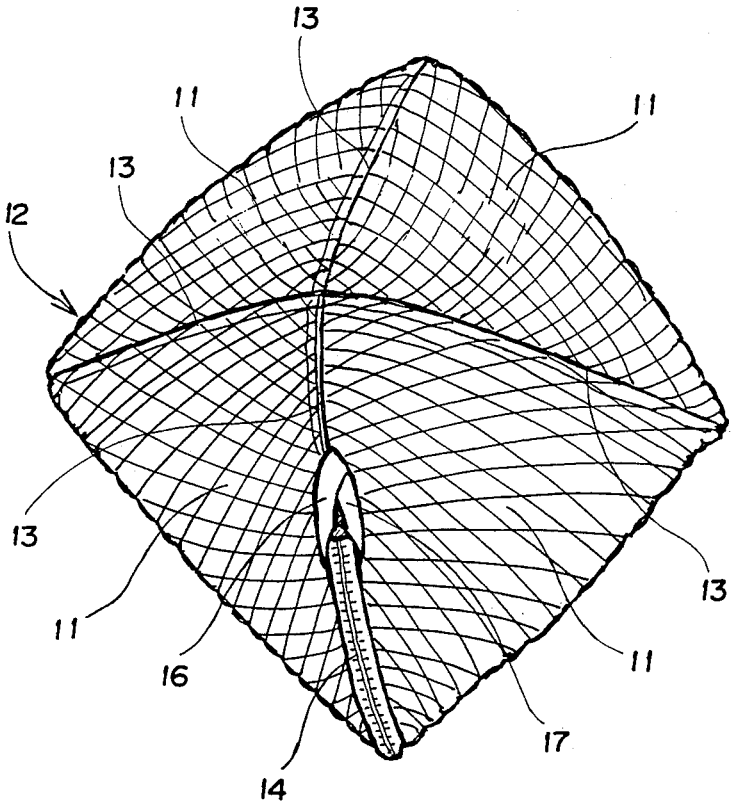
FIG. 2 is a perspective view showing an embodiment& of a laundry net according to the present invention, which is viewed from a position at which a slide fastener is partially seen.
Figure 3:
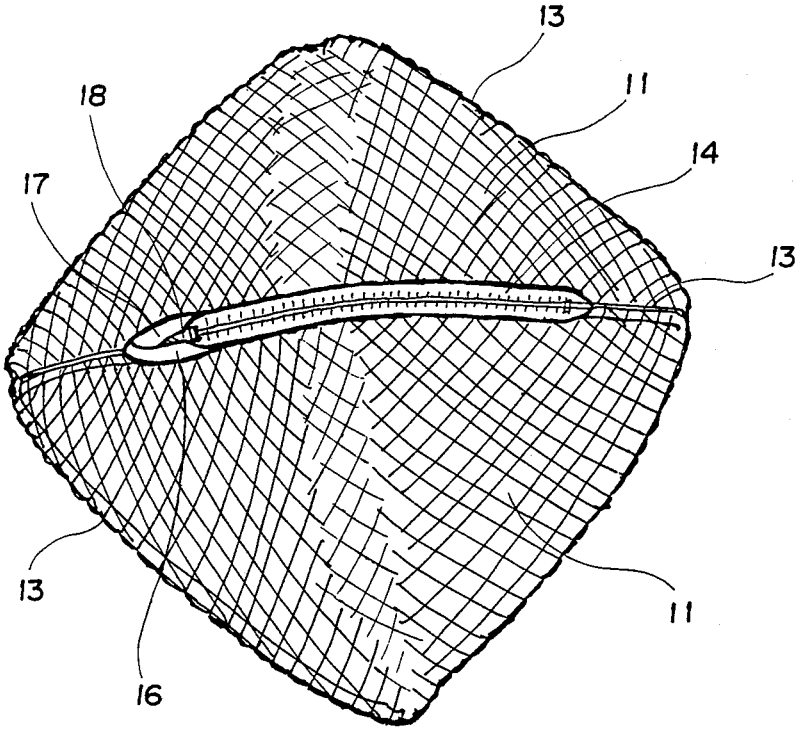
FIG. 3 is a perspective view of the laundry net shown in FIG. 2, which is viewed from a position at which the slide fastener is wholly seen.
Figure 4:
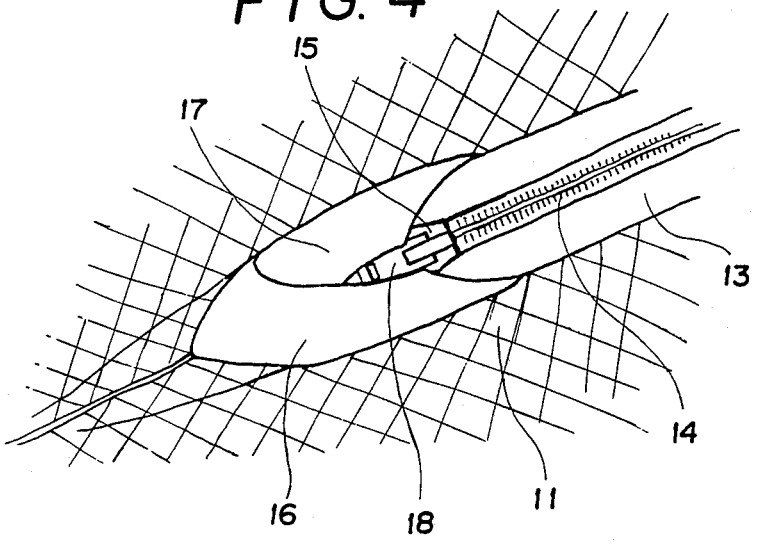
FIG. 4 is a fragmentary enlarged perspective view showing a slider of a slide fastener on which a cover is put.

FIGS. 2 to 4 illustrate an embodiment of laundry net according to the present invention. A laundry net of the illustrated embodiment includes a net body 12 comprising four net members 11 formed into a rhombic shape and joined together by stitching, resulting in a plurality of stitched sections 13 being formed between the respective adjacent two net members 11. The so-constructed net body 12 takes an octahedron when it is expanded. Any one of the stitched sections 13 is provided with a slide fastener 14 including a slider 15 with a lug 18. The stitched section 13 is also provided with covers 16 and 17 for covering the slider 15 and lug 18 at the portion thereof at which the slide fastener 14 is positioned when the slide fastener 14 is closed. In the illustrated embodiment, the covers 16 and 17 each are made of fabric. The covers 16 and 17 are overlapped with each other at their proximal end as shown in FIG. 4, so that the slider 15 and lug 18 are covered with the so-formed overlap portion between both covers 16 and 17 when the slide fastener 14 is closed.

Now, the manner of operation of the so-constructed laundry net of the illustrated embodiment will be described hereinafter.

First, the covers 16 and 17 are unfolded and then the lug 18 of the slider 15 is drawn out from the overlap portion of the covers 16 and 17 to move the slider, to thereby open the slide fastener 14. Subsequently, washing to be washed is received in the net body 12 and then the slide fastener 14 is closed. At this time, the slider 15 is covered with the covers 16 and 17 together with the lug 18. Thereafter, the laundry net in which the washing is received is put in a wash tub of a washing machine.

The net body 12, as described above, is formed into an octahedron. Such configuration of the net body 12 permits water to constantly flow into the net body 12 and through the interior of the net body 12 irrespective of its position with respect to the flow of water in the wash tub of the washing machine, so that the washing in the net body 12 may be positively contacted with the flowing water, leading to effective removal of stain from the washing.

Also, the slider 15 and lug 18 of the slide fastener 14 mounted on the net body 12 is positively covered with the overlap portion of the covers 16 and 17, to thereby effectively prevent the slider 15 and lug 18 from damaging washing outside the laundry net.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A laundry net comprising:

a net body formed into an octahedron, said net body comprising four net members formed into a rhombic shape and joined together by stitching, resulting in stitched sections being formed between the respective adjacent two net members;

a slide fastener including a slider and arranged at one of said stitched sections; and cover means arranged at the portion of said one stitched section at which said slide fastener is positioned when the slide fastener is closed, to thereby cover said slider of said slide fastener.

2. A laundry net as defined in claim 1, wherein said cover means comprises two covers arranged in a manner to form an overlap portion therebetween;

said slider being hidden in said overlap portion.

3. A laundry net as defined in claim 1 or 2, wherein said cover means is made of fabric.

4. A laundry net as defined in claim 1, wherein said slider is provided with a lug;

said lug being covered with said cover means together with said slide.

* * * * *